US007743562B2

(12) United States Patent
Wedi

(10) Patent No.: US 7,743,562 B2
(45) Date of Patent: Jun. 29, 2010

(54) LIGHT PLASTIC FOAM CONSTRUCTION ELEMENT FOR MAKING SHOWER STALLS, BATHROOM STALLS AND THE LIKE

(76) Inventor: Stephan Wedi, Kolpingstrasse 52-54, 48282 Emsdetten (DE)

( * ) Notice: Subject to any disclaimer, the term of this patent is extended or adjusted under 35 U.S.C. 154(b) by 0 days.

(21) Appl. No.: 11/650,143

(22) Filed: Jan. 5, 2007

(65) Prior Publication Data

US 2007/0157527 A1 Jul. 12, 2007

(30) Foreign Application Priority Data

Jan. 7, 2006 (DE) ..... 20 2006 000 163 U

(51) Int. Cl.
*A47K 3/16* (2006.01)

(52) U.S. Cl. ..... 52/34; 52/220.1; 52/309.3; 4/614

(58) Field of Classification Search ..... 52/34, 52/35, 287.1, 220.1, 309.9, 309.7, 309.8, 52/309.12, 309.14, 309.16, 309.17, 315, 52/320, 405.1, 471, 468; 4/612, 614, 570
See application file for complete search history.

(56) References Cited

U.S. PATENT DOCUMENTS

| | | | | |
|---|---|---|---|---|
| 2,586,612 | A * | 2/1952 | Caldwell | 4/657 |
| 3,765,139 | A * | 10/1973 | Litvin et al. | 52/205 |
| 4,186,536 | A * | 2/1980 | Piazza | 52/309.12 |
| 4,232,494 | A * | 11/1980 | Bauch et al. | 174/504 |
| 4,671,026 | A * | 6/1987 | Wissinger | 52/35 |
| 4,938,825 | A * | 7/1990 | Macdonald | 156/245 |
| 5,070,549 | A * | 12/1991 | Campe | 4/596 |
| 5,350,884 | A * | 9/1994 | Littrell | 174/489 |
| 5,997,009 | A * | 12/1999 | Geise | 277/650 |
| 6,205,729 | B1 * | 3/2001 | Porter | 52/309.7 |
| 6,226,943 | B1 * | 5/2001 | Grinshpun et al. | 52/309.4 |
| 6,610,382 | B1 * | 8/2003 | Kobe et al. | 428/119 |
| 6,933,036 | B2 * | 8/2005 | Whitaker | 428/141 |
| 6,990,695 | B2 * | 1/2006 | Grayson | 4/613 |
| 2004/0009329 | A1 * | 1/2004 | Whitaker | 428/141 |

FOREIGN PATENT DOCUMENTS

| | | |
|---|---|---|
| DE | 41 00 737 C1 | 1/1991 |
| DE | 44 01 086 A1 | 3/1995 |
| DE | 100 60 870 C1 | 12/2000 |
| EP | 0 424 690 A1 | 9/1990 |
| WO | WO 2004/084693 | 10/2004 |

* cited by examiner

*Primary Examiner*—David Dunn
*Assistant Examiner*—Daniel Kenny
(74) *Attorney, Agent, or Firm*—Karl F. Milde, Jr.; Eckert Seamans Cherin & Mellott, LLC

(57) ABSTRACT

A lightweight plastic foam construction element (1), for use in making shower stalls, bathroom partitions and the like, consists of a plastic foam core (4) with at least one external mortar layer (8) reinforced with fibers. The construction element has wall areas that are reinforced with at least one adhered wall component of more rigid material for the attachment of installation components that extend over the outer surface on an operational, working side of the construction element. The wall components (11) are inserted into a groove (10) cut into the working side, and the groove is sealed on the working side using a foam filler element (12).

16 Claims, 1 Drawing Sheet

LIGHT PLASTIC FOAM CONSTRUCTION ELEMENT FOR MAKING SHOWER STALLS, BATHROOM STALLS AND THE LIKE

BACKGROUND OF THE INVENTION

The invention relates to a lightweight construction element that is especially suitable for constructing shower cabinets, sanitary partitions, and similar walls for bathrooms, etc. The construction element comprises a plastic foam core with at least one external fiber-reinforced mortar layer and a wall area that is reinforced with at least one wall component of more rigid material for the attachment of installation components that project out from the outer surface on the operational, working side of the lightweight construction element.

Such a lightweight construction element is known from a construction-element kit for round shower cabinets, as described in DE 41 00 737 C1. This reference states that the foam material used in this element is not strong enough to have installation components, which are under pressure or tension (faucets, handgrips, etc.), directly connected to it. It is therefore recommended to cut parts of this wall material out at these locations, and to adhere wall components of stronger material, e.g., lightweight concrete, to which one may then attach the installation devices.

SUMMARY OF THE INVENTION

It is the principal objective of the invention to transfer the basic concept alluded to in the aforementioned document into an embodiment that may be included, particularly in existing systems of construction-element kits, that allows simple further processing in continuous form upon assembly of the elements, and is nevertheless inexpensive.

This objective is achieved by a lightweight construction element of the above-mentioned type in which the wall component(s) is/are inserted into a groove cut into the working side, the groove being closed on the working side by means of a foam filler element.

The material selection for the wall component is a particular pre-requisite. The material involved must be waterproof or water-resistant. The state of the art dictates lightweight concrete. Within the scope of such materials, particle boards or plaster-cardboard boards made water-resistant may also be used.

Based on experience, a non-foamed polyurethane with mixture of thermoplastics and catalysts has proved to be particularly suitable. Such a material is known under the trade name Phonotherm®. The desired dimensional stability under constant wet conditions is less than 1%, and preferably is below 0.5% using the named material Phonotherm®.

Phonotherm® material is available commercially from Schmid Baukunststoffe GmbH, in Gingen, Germany. Further information about this material may be found at www.phonotherm.de.

As previously mentioned, the lightweight construction element may be a corrugated section or a round shower cabinet.

The filler element forming the connection preferably consists of the same plastic foam as the other lightweight construction elements. It should also possess the same mortar layer as the lightweight construction element.

Highly efficient production is possible if the wall component is of one piece, and if it extends over the entire height of the lightweight construction element. In such case, the entire height is used, and may be provided with suitable installation components without limitations arising. One may not exclude, however, the possibility that the wall component consists of several parts that may be positioned overlapping or adjacent to one another.

For a full understanding of the present invention, reference should now be made to the following detailed description of the preferred embodiments of the invention as illustrated in the accompanying drawings.

DESCRIPTION OF THE PREFERRED EMBODIMENTS

Figure 1:
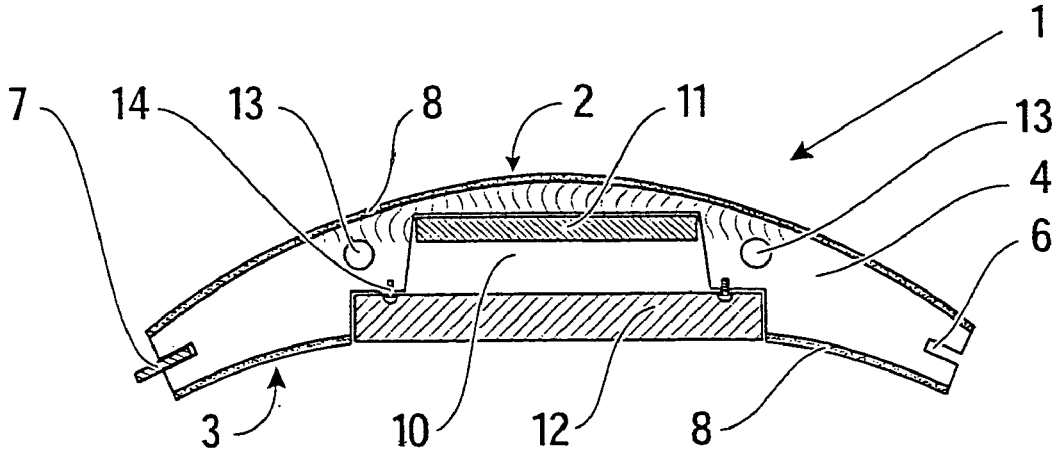
FIG. 1 is a lightweight construction element according to the invention in cutaway view.

The preferred embodiments of the present invention will now be described with reference to FIGS. 1-2 of the drawings. Identical elements in the figures are designated with the same reference numerals.

Figure 2:
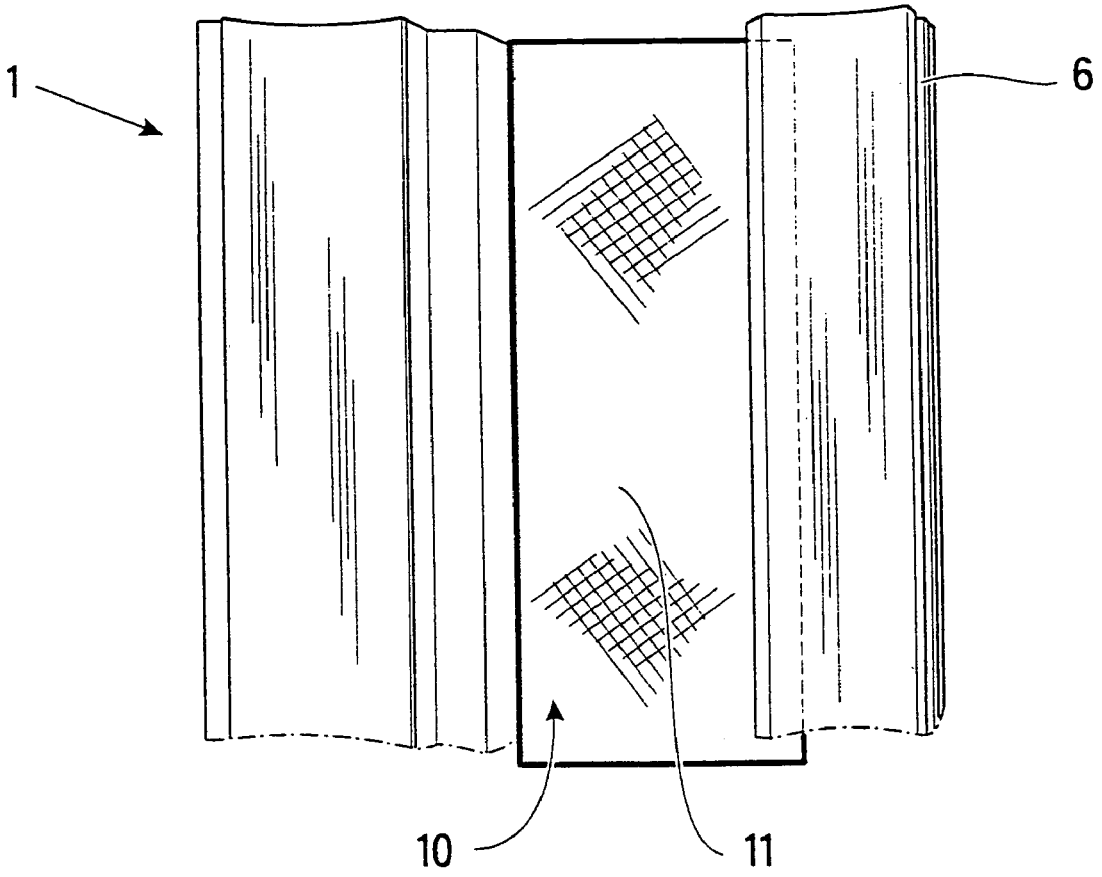
FIG. 2 is the lightweight construction element per FIG. 1 with applied wall component, but without a filler element.

The lightweight construction element 1 shown in FIGS. 1 and 2 is, according to the invention, a curved section of a round shower cabinet. The lightweight construction element 1 consists of an essentially non-elastic foam core 4 of a plastic such as polyethylene. The two differently-curved main sides 2 and 3 are coated with a hardened concrete or mortar layer 8 that is reinforced with a fiberglass mat. The layer 8 on the main sides 2 and 3 may be covered with mosaic tiles or an appearance coating after erection of the round shower cabinet. The materials used for this, and for the lightweight construction element itself, are known (see DE 100 60 870 C1 and others).

In cross-section, the lightweight construction element possesses the shape of a crescent moon. The cross section is relatively large in the center, but reduces toward the outer edges. These edges are provided with a slot 6 along their entire height. When the lightweight construction elements are assembled, opposing slots are connected using splines 7. In other words, the edges are provided with slots and the fastening element is a spline element insertable in the slots.

A groove 10 is cut into the working side (the inner side) of the central area of the lightweight construction element 1, whereby a stepped channel that narrows toward the inner side is formed. A wall component 11 in the form of a board with rectangular cross section is inserted and adhered to the base of the groove 10. The thickness and width of the wall component 11 are based on technological necessities. More or less heavy installation components to be mounted on the wall component 11, the width of the wall component, and the strength of surrounding foam of the lightweight construction element must be taken into account.

In any case, a water-resistant (waterproof if possible) material must be used for the wall component 11 that is nevertheless inexpensive and lightweight. The lightweight construction elements must not become much heavier after installation of the wall component 11. Metallic materials are therefore less suitable. Several such wall components may be distributed over the height of the lightweight construction element, each at its own separation. In a preferred embodiment a single component extends over the entire height of the lightweight construction element.

A non-foamed polyurethane material produced from leftovers of polyurethane hard foam as a recycled material is suitable as material for the wall component 11. The material is formaldehyde-free, and possesses a plate thickness of about 15 mm in the illustrated embodiment example. Its density is 400 to 800 kg/m$^3$. Its bend resistance is between 7 and 11 N/mm$^2$. The waterproof factor of the material used is high, and dimensional alteration is only 0.5% after 24 hours' water immersion, or in the worst case 1%. Such a material is available from Schmid Baukunststoff GmbH, Gingen, Germany, under the trademark Phonotherm®.

Other materials such as light concrete, thermoplastics, water-resistant particle board, or plaster-cardboard sheets are also suitable, of course. One must always ensure that operational requirements and anticipated loads, such as during installation of shower rods and handgrips, are taken into account.

In order to allow the wall component 11 with necessary lines and connections (not shown here) to retreat optically into the background, the groove 10 is firmly affixed to a foam filler element 12 on the working side, i.e., on the inner side over which the installation components extend.

The foam filler element 12 is a cut piece of plastic foam plate covered on one or both sides with reinforcing mortar that may be easily inserted and adhered. The thickness of the foam filler element 12 is about 20 mm. The pass-through openings for the installation components and their threaded fastenings that end within the wall component may easily be drilled using conventional drills. The wall component(s) 11 may also be attached with the other parts of the lightweight construction element using adhesive and additional connecting elements, or merely additional connecting elements, particularly screws 14.

One or more channels 13 are provided in the foam core 4 for hot and cold water tubes, respectively.

It must be mentioned here that the shape of a lightweight construction element may deviate from the illustrated one. The element may also be plate-shaped and flat; it may be shaped as an angled element or a floor panel. It may be installed in horizontal, vertical, or oblique position. The position is preferably vertical in connection with other wall-type elements, whereby the other elements do not possess an inserted wall component 11.

The foamed material of the lightweight construction element is also suited to direct embedding of water-line cutouts or branch lines outside the wall components 11 and outside the filler element into the foam material. Thus, for example, hot-water lines may be routed and connected directly with a mixer or a shower-head line that is firmly affixed to the wall component.

There has thus been shown and described a novel light plastic foam construction element for making shower stalls, bathroom stalls and the like which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A lightweight construction element forming an upright wall for a bathroom shower incorporating plumbing fixtures, said construction element comprising a plastic foam core with at least one external, fiber-reinforced mortar layer and an inner area of the wall that is reinforced with at least one wall component of more rigid material for the attachment of the plumbing fixtures that project out from an inner surface on one side of the lightweight construction element that forms a working side facing the shower area, the improvement wherein said at least one wall component is inserted into a groove cut into said working side of the plastic foam core, wherein the groove is sealed on the working side using a foam filler element in the form of a plastic foam board, wherein the wall component is of a waterproof plastic, and wherein the groove is in the form of a channel cut with a mirror-symmetrical stepped cross-section that narrows toward the inner side, whereby the groove has opposing steps and at least the filler element rests against the opposing steps, thereby hiding the wall component.

2. A lightweight construction element as in claim 1, wherein the wall component is of a plastic whose dimensional alteration after immersion in water for 24 hours is less than 1%.

3. A lightweight construction element as in claim 1, wherein the wall component is of water-resistant particle board or plaster cardboard plate.

4. A lightweight construction element as in claim 1, wherein the wall component is of a non-foamed polyurethane with admixtures of thermoplastics and additives.

5. A lightweight construction element as in claim 1, wherein the lightweight construction element forms a curved section of a round bathroom shower cabinet.

6. A lightweight construction element as in claim 1, wherein the filler element is of foamed plastic, and includes on one side of the same mortar coating as the lightweight construction element.

7. A lightweight construction element as in claim 1, wherein the wall component extends over the entire height of the lightweight construction element.

8. A lightweight construction element as in claim 1, wherein the groove forms a channel with a mirror-symmetrical stepped cross-section that narrows toward the inner side, and wherein the filler element rests against opposing steps in the stepped cross-section.

9. A lightweight construction element as in claim 1, wherein at least one of the wall component and the filler element are attached to the other parts of lightweight construction element.

10. A lightweight construction element as in claim 1, wherein cutouts for water-lines and branch lines are directly embedded into the foam material of the lightweight construction element outside the wall component and outside the filler element.

11. A lightweight construction element as in claim 1, wherein the edges of the lightweight construction element are provided with fastening elements.

12. A lightweight construction element as in claim 11, wherein the edges are provided with slots and the fastening element is a spline element insertable in the slots.

13. A lightweight construction element as in claim 9, wherein said at least one of the wall component and filler element is attached by means of an adhesive.

14. A lightweight construction element as in claim 9, wherein said at least one of the wall component and filler element is attached by means of on or more screws.

15. A lightweight construction element forming an upright wall for a bathroom shower incorporating plumbing fixtures, said construction element comprising a plastic foam core having an inner working surface and an outer surface with at least one outer, fiber-reinforced mortar layer, wherein the inner working surface has a groove that has two or more steps and that narrows going into the foam core from the inner working surface;

a wall component of material more rigid than the foam core that is positioned in the narrower or narrowest step of the channel to support plumbing that projects through the inner working surface; and a foam filler element in the form of a plastic foam board that is positioned in a step of the channel at the inner surface, seals the channel, and has openings through which plumbing projects, wherein the wall component is of a waterproof plastic and wherein the groove is in the form of a channel cut with a mirror-symmetrical stepped cross-section that narrows toward the inner side, whereby the groove has opposing steps and at least the filler element rests against the opposing steps, thereby hiding the wall component.

16. A lightweight construction element as in claim 15 which is arcuate.

* * * * *